US005388602A

United States Patent [19]

Coassin et al.

[11] Patent Number: 5,388,602

[45] Date of Patent: Feb. 14, 1995

[54] DESCALING DEVICE EMPLOYING WATER

[75] Inventors: Giovanni Coassin, Pordenone; Franco Driussi, Nogaredo Di Prato-Martignacco; Fausto De Marco, Remanzacco; Gianni Rattierri, Pradamano, all of Italy

[73] Assignee: Danieli & C. Officine Meccaniche SpA, Buttrio, Italy

[21] Appl. No.: 93,000

[22] Filed: Jul. 19, 1993

[30] Foreign Application Priority Data

Jul. 31, 1992 [IT] Italy ..... UD92A000129
Nov. 23, 1992 [IT] Italy ..... UD92A000172

[51] Int. Cl.[6] ..... B08B 3/02

[52] U.S. Cl. ..... 134/122 R; 118/316; 118/323; 134/144; 134/180; 134/182; 266/113; 266/114

[58] Field of Search ..... 134/64 R, 122 R, 129, 134/144, 154, 172, 180, 181, 182; 118/316, 323; 266/113, 114; 62/64, 373

[56] References Cited

U.S. PATENT DOCUMENTS

| | | | |
|---|---|---|---|
| 2,822,635 | 2/1958 | Mears | 134/64 R X |
| 3,023,756 | 3/1962 | Proctor | 134/181 X |
| 3,428,023 | 2/1969 | Cox et al. | 266/113 X |
| 3,511,250 | 5/1970 | Gallucci et al. | 134/122 R |
| 4,256,168 | 3/1981 | Hein et al. | 134/180 X |
| 4,371,149 | 2/1983 | Takeuchi et al. | 266/113 X |
| 4,440,584 | 4/1984 | Takeshige et al. | 266/114 X |
| 4,444,556 | 4/1984 | Andersson | 62/64 X |

FOREIGN PATENT DOCUMENTS

| | | | |
|---|---|---|---|
| 0231877 | 1/1987 | European Pat. Off. . | |
| 0489979 | 12/1990 | European Pat. Off. . | |
| 484882 | 11/1991 | European Pat. Off. . | |
| 2172726 | 2/1973 | France . | |
| 2271884 | 5/1975 | France . | |
| 2605011 | 7/1977 | Germany . | |
| 136709 | 7/1979 | Germany . | |
| 3125146 | 6/1981 | Germany . | |
| 3150946 | 7/1983 | Germany . | |
| 161189 | 12/1979 | Japan | 134/64 |
| 59-110418 | 6/1984 | Japan . | |
| 59-110786 | 6/1984 | Japan . | |
| 8900012 | 1/1989 | Netherlands . | |
| 1071837 | 6/1967 | United Kingdom . | |
| 2091133 | 1/1981 | United Kingdom . | |

OTHER PUBLICATIONS

Danieli Company Brochure, Buttrio-Udine, IT 4 pages, "Direct Hydraulic Descalers" pp. 2-3.

*Primary Examiner*—Philip R. Coe
*Attorney, Agent, or Firm*—Antonelli, Terry, Stout & Kraus

[57] ABSTRACT

Descaling device employing water to descale blooms, thin slabs, billets, etc., which cooperates with a mould and the zone immediately downstream therefrom, or with an induction furnace or rolling mill stands, the slabs or blooms (11-24) being fed in cooperation with the descaling device at a speed of feed of the order of 1.5-20 meters per minute, but advantageously between 4 and 10 meters per minute, the device consisting of at least one movable arm (12-13) bearing nozzle means (14) delivering descaling water, the movable arm (12-13) being associated with the face of the slab or bloom (11-24) to be descaled and having a working phase, in which the descaling water acts on the surface of the slab or bloom (11-24), and a shut-off phase, in which the descaling water does not act on the surface of the slab or bloom (11-24).

11 Claims, 6 Drawing Sheets

DESCALING DEVICE EMPLOYING WATER

BACKGROUND OF THE INVENTION

This invention concerns a descaling device employing water.

The descaling device employing water according to the invention is used advantageously to remove the layer of oxides formed on the surface of the blooms or slabs immediately downstream of the mould, downstream of the induction furnace or immediately upstream of the rolling mill stands.

The invention is especially suitable for thin slabs or in all cases of the movement of slabs at a low speed, for instance when the continuous casting plant or the heating furnace is located in direct cooperation with the rolling line.

The device is employed advantageously with thin slabs between 20 and 80 mm. thick or with slabs or blooms being fed at a speed between 1.5 and 20 meters per minute, but advantageously between 4 and 10 meters per minute.

Various methods are known for the removal of the scale which forms on the surface of metallic workpieces during casting or heating upstream of the hot deformation, or during heat treatment, of those workpieces.

These descaling methods are divided substantially into mechanical methods, chemical methods and chemical-mechanical methods, depending on how they are carried out.

A method of removal of scale by high-pressure jets of water is generally used in rolling mills, the jets being directed at a suitable inclination against the slabs being fed forwards.

According to this method the faces to be descaled of moving blooms or slabs are continuously lapped by jets of water emitted by stationary nozzles at a pressure of about 12–40 MPa.

This method is unsuitable for the descaling of blooms or slabs being fed at a low speed since these jets of water under pressure cause excessive cooling of the bloom or slab.

This unfavourable effect is especially marked where the thin slabs have both their wide faces lapped by the continuous flow of descaling water.

Moreover, an efficient descaling action requires a given relative speed between the delivery jet and the bloom being fed and a considerable rate of flow of water divided between a great number of nozzles; for instance about 800 liters per minute split between 36 nozzles, are required to achieve efficient descaling of blooms having a square cross-section with sides of 280 mm.

The high rate of flow of water, besides the waste involved, entails the problem of generating a great quantity of steam when the water strikes the bloom.

The great quantity of water required involves also the employment of very powerful feed pumps and pipes of great sizes.

Moreover, owing to the excessive cooling the bloom has to be re-heated before undergoing the rolling and subsequent processes.

This method is therefore effective only in rolling plants of a discontinuous type where the rolling speed is high enough, but is unacceptable in continuous rolling plants where the rolling speed is the same as or close to the casting speed and is therefore especially slow.

EP-A-0484882, U.S. Pat. No. 3,511,250, FR-A-2.271.884 and the Patent Abstract of Japan, Vol. 8, No. 230 disclose descaling devices employing water in which the nozzles are moved, for instance by rack and pinion systems or piston-cylinder systems, in a direction crosswise to the direction of feed of the slab; but these devices do not include periods of stoppage of the delivery of water and therefore entail wastage, generation of great quantities of steam, excessive reduction of the temperature of the slab, etc.

In particular, EP-A-0484882 arranges to descale the two opposed faces of a slab between 200 and 240 mm. thick with counterpart Jets of water. This system creates concentrated surface cooling, which becomes especially unfavourable near the edges, which already tend to be too cool.

GB-A-1,071,837 and DE-B-2.605.001 include nozzles able to move to and fro on the axis of the slab being fed and provide for stoppage of the water during the return movement of the nozzles to their position of re-starting the cycle, but do not explain the reason for this stoppage.

GB-A-1,071,837 in particular concerns cylindrical bars and especially hollow cylindrical bars, includes a plurality of delivery nozzles and does not mention the values of pressure or rate of flow of the water which characterise the device.

DE-B-2.605.001, which is dated eleven years later, provides for the descaling of slabs with a jet of water, which is moved alternately to and fro in the direction of feed of the slab, substantially as in GB-A-1,071,837.

SUMMARY OF THE INVENTION

The present applicants have designed, tested and embodied this invention to overcome the shortcomings of the state of the art and to achieve further advantages.

The purpose of this invention is to provide a device for the removal of scale formed on the surface of blooms or slabs, especially thin slabs; the invention is especially suitable for plants where the rolling line is positioned in direct cooperation with the continuous casting plant or heating furnace, or where it is not desired to employ great power to feed the blooms or slabs at a high speed.

A further purpose of the invention is to provide a device which accomplishes efficient descaling with a great saving of water as compared to the systems of the state of the art and restricts to a minimum the lowering of the temperature of the slab passing through.

Another purpose of the invention is to embody a device which is simple, inexpensive and needs little or no maintenance.

Yet another purpose is to avoid the formation of too cold zones in the slab and, in particular, too great cooling of its edges.

Still another purpose is to allow the internal heat to rise to the surface so as to make the temperature of the slab uniform.

The invention arranges to subject the desired face of the slab in motion to a mechanical descaling action by means of one or more nozzles suitable to deliver concentrated jets of water in a desired manner at a high pressure against the surface of the slab.

According to the invention the jets of water do not act continuously on the surface of the slab to be descaled.

These one or more nozzles are fitted to suitable movable arms, which bring the jet of water momentarily into cooperation with the surface of the slab undergoing the descaling action.

According to a variant the nozzles are associated with a rotary head fitted in its turn to the movable arms; the combined arrangement of the movements of the rotary head and of the movable arms brings about an action which can be likened to a milling action on the surface of the slab by jets of water.

In this case the pressure at the pumps can be brought up to very high levels reaching 600–700 bar.

According to the invention this pressure is adjusted to suit the temperature and thickness of the slab, the type of steel and the thickness of the scale.

According to a first embodiment of the invention, which is advantageous for thin slabs, the movable arms are capable of linear movement.

The nozzles are characterised in each cycle by a first descaling movement, whereby they are moved from an initial position substantially at one lateral edge of the thin slab to a final position substantially at the opposite edge of the thin slab.

The nozzles are brought with a second return movement from that final position back to their initial position; this second return movement is associated with a shut-off of the delivery of water.

A period of halting or inactivity may be included at about one and/or the other positions of inversion of movement.

The combined arrangement of the relative movements of the thin slab and of the nozzles leads to an action of removal of scale from the surface of the thin slab along parallel strips which are perpendicular or inclined to the lengthwise axis of feed of the slab and are in the direction of the width of the thin slab.

According to the invention the nozzles acting on one face of the thin slab are arranged so as to carry out the spraying cycle in a direction opposite to that of the nozzles acting on the opposite face of the thin slab.

The upper nozzles are moved, for instance, in a direction which goes from right to left in relation to the lengthwise axis of the thin slab, whereas the lower nozzles are moved from left to right.

This lay-out has the effect that the respective lower and upper parallel strips affected by the descaling action are not parallel but cross over each other and intersect each other ideally at the centre of the thin slab.

In view of the modest thickness of the thin slab this layout prevents too great cooling of the thin slab and at the same time enables the internal heat to become equal to its surface heat.

The shut-off of delivery of water enables a great saving to be made in the quantity of feed water required to fulfill the action of removal of scale.

The length of the descaling cycle and any inactive time are synchronised with the speed of feed of the thin slab, so that each spraying cycle affects a portion of the surface of the slab not wholly lapped by the previous spraying cycle and ensures that the whole surface is lapped, with a slight superimposing at the sides of the descaled strips.

The arrangement of the nozzles side by side is carried out advantageously in such a way that one nozzle collects and removes the scale detached by another nozzle, thus conveying the scale.

In this way the scale is wholly eliminated in each descaling cycle from the surface of the slab and is distanced from the rolling rolls.

According to another embodiment of the invention, which is advantageous for thin slabs and blooms, one or more nozzles are fitted to one or more rotary arms having their axis of rotation advantageously perpendicular to the surface to be descaled. The axis of rotation can also be inclined, advantageously forward, in relation to the surface to be descaled.

Each rotary arm is associated with at least a part of one side of the bloom or slab involved in the descaling action and bears nozzles at its end.

The jets of water generated by these nozzles are advantageously partly staggered and superimposed on each other to avoid creating intermediate zones which are not affected or only slightly affected by the jet of water.

The rotation of the arm and of the nozzles associated therewith fulfils an action of removal of the scale, from the bloom or slab passing through, along arcs of a circle described by the nozzles.

According to the invention the descaling is carried out on arcs which are reciprocally adjacent and slightly superimposed and which, as a whole, cover the whole surface of the bloom or slab.

In this way the surface of the bloom or slab is not lapped by several passes of the jet of water and excessive undesired cooling is obviated.

The speed of rotation of the arm, the inclination of the jet of water and the distance of the nozzle from the bloom or slab are selected according to the desired descaling action.

A metallic sheet or plate is fitted advantageously below the rotary arm in the part downstream of the descaling action on the bloom; this sheet is positioned in such a way that during a complete rotation of the rotary arm the jet of water is prevented from lapping parts of the surface of the bloom which have already been descaled, and at the same time enables the water to be recovered.

This enables undesired and useless cooling of the parts already descaled to be obviated and provides the advantage of not having to shut off and then re-start the delivery of water at very short intervals.

Where each face of the slab is affected by the action of several rotary arms acting at the same time on the same face of the slab, those arms can be aligned diagonally for instance, so that each jet of water performs an action of sideways removal of the scale detached by the immediately adjacent jet of water.

When the nozzles are fitted to a head which too can rotate, a combination of two rotary motions is achieved, and therewith a descaling action which can be likened to milling of the surface of the slab.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

In FIGS. 1 to 4 the reference number 10 denotes a device to descale thin slabs 11 or billets or blooms 24 according to the invention.

Figures 1, 4:
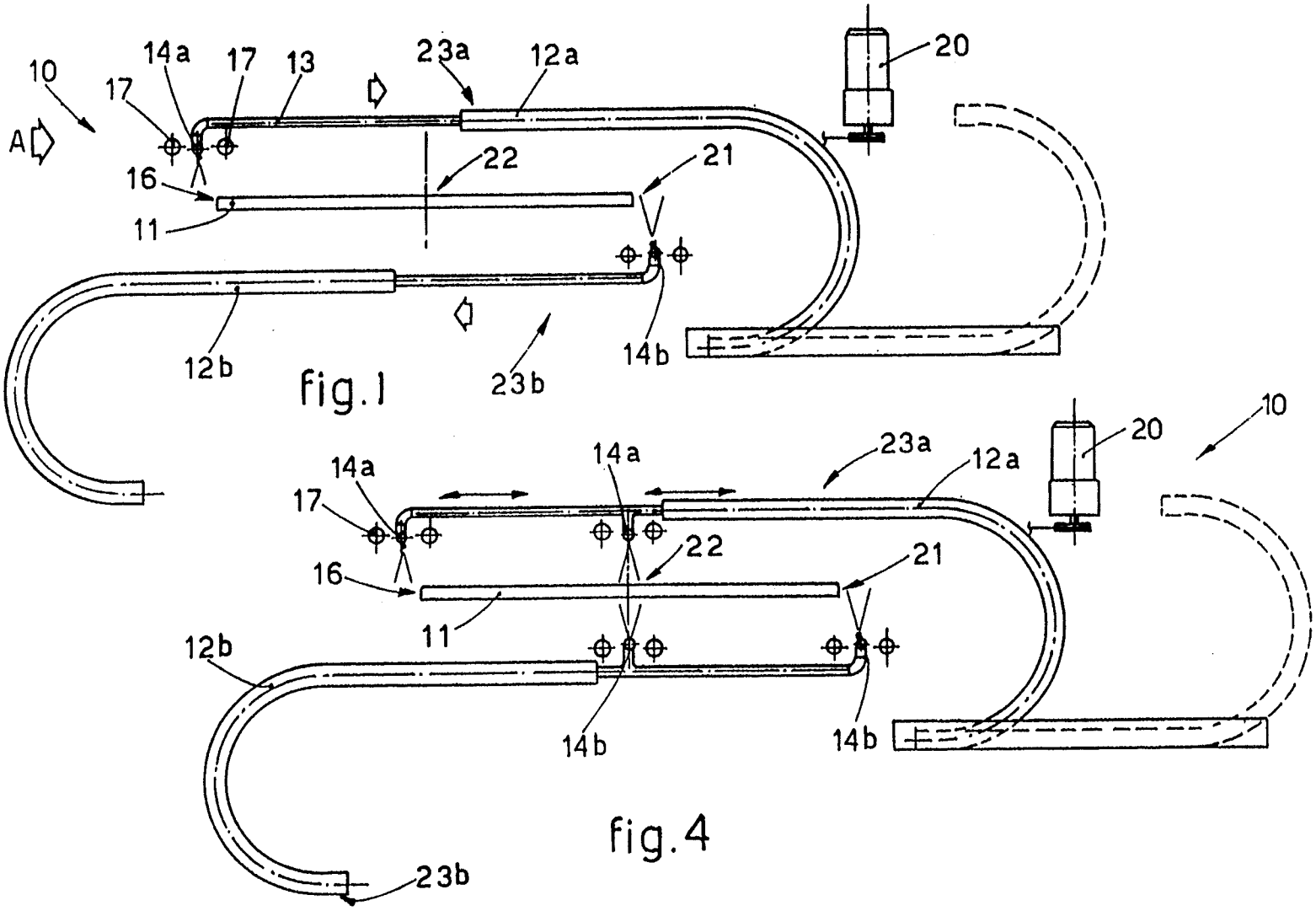
FIG. 1 is a drawing of a front view of the device with linearly movable arms according to the invention.
FIG. 4 is a variant of FIG. 1.

According to the lay-out shown in FIG. 1 the device 10 according to the invention consists of two assemblies 23, namely an upper assembly 23*a* and a lower assembly 23*b*. Each assembly 23*a*–23*b* consists of a linearly movable arm 12, thus an upper arm 12*a* and a lower arm 12*b*; these arms are arranged substantially parallel to each other and to the plane along which the thin slab 11 is fed.

In this example each movable arm 12 bears at its end a pair of nozzles 14, thus upper nozzles 14*a* and lower nozzles 14*b*.

Figure 2:
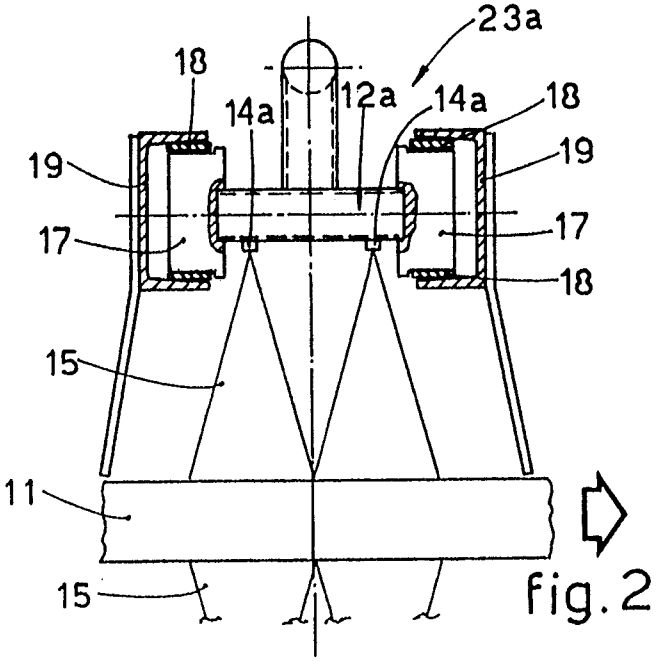
FIG. 2 shows in an enlarged scale a partial view of a cross-section of the device of FIG. 1 according to the arrow A.
Figure 3:
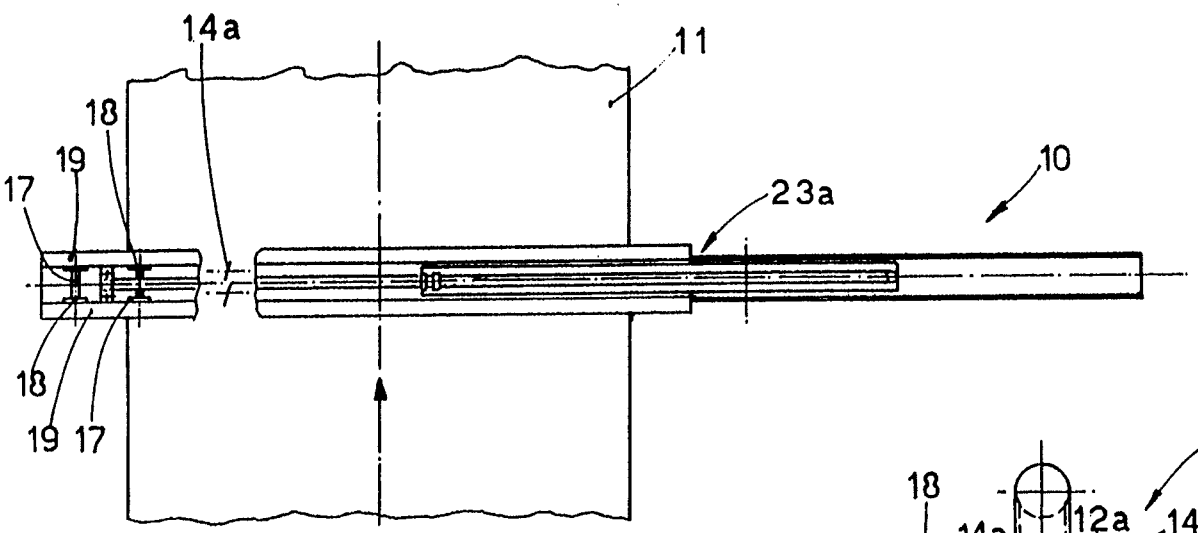
FIG. 3 is a plan view of the device of FIG. 1.

Side-by-side water walls 15 which are thus formed may be separate, as shown in FIG. 2, or may be at least partly superimposed on each other so as to avoid the risk of creating, along the line of separation between the water walls 15, a zone not lapped or only marginally lapped by the action of the jets of water.

The water walls 15 can be staggered advantageously to create a progressive action of discharge of scale.

If an efficient action of removal of scale is to be achieved, the angle of incidence of the jet of water against the surface of the thin slabs 11 is deviated advantageously by about 15° from the perpendicular.

The movable arms 12 are associated with displacement means, which take the nozzles 14 by a first descaling movement from an initial position coinciding substantially with one lateral edge 16-21 of the thin slab 11 to a position coinciding with the opposite lateral edge 21-16 of the thin slab 11.

This first movement is associated with delivery of a jet of descaling water.

The descaling action is performed along parallel strips across the width of the thin slab 11. Depending on the initial arrangement of the movable arms 12 or on the direction of movement of the movable arms 12, the parallel strips may be inclined to a line perpendicular to the lengthwise axis of the thin slab 11 or may coincide with that perpendicular line. Such inclination will be advantageously between 0.5° and 30°.

A second return movement of the nozzles 14 to their initial position is associated with a shut-off of the delivery of water, thus enabling a great saving of the quantity of water used for the descaling to be achieved together with tempering of the thin slab 11.

The cycle times are coordinated with the speed of feed of the thin slab 11 and with the width of the water walls so as to arrange that the whole surface of the thin slab 11 is lapped by the descaling action of the jet of water and that the surface of the thin slab 11 is lapped by only one pass of the jet of water, thus preventing undesired, excessive cooling.

When the speed of feed of the thin slab 11 is especially slow, inactive periods for the nozzles 14 may be included between two successive cycles.

The means which displace the movable arms 12 consist here of small movable trolleys 17, which support the movable arms 12 laterally and are equipped with wheels 18.

These small movable trolleys 17 are driven by a motor 20 and run on suitable guides 19 with a regular to-and-fro movement in the direction of the width of the thin slab 11.

Figure 12:
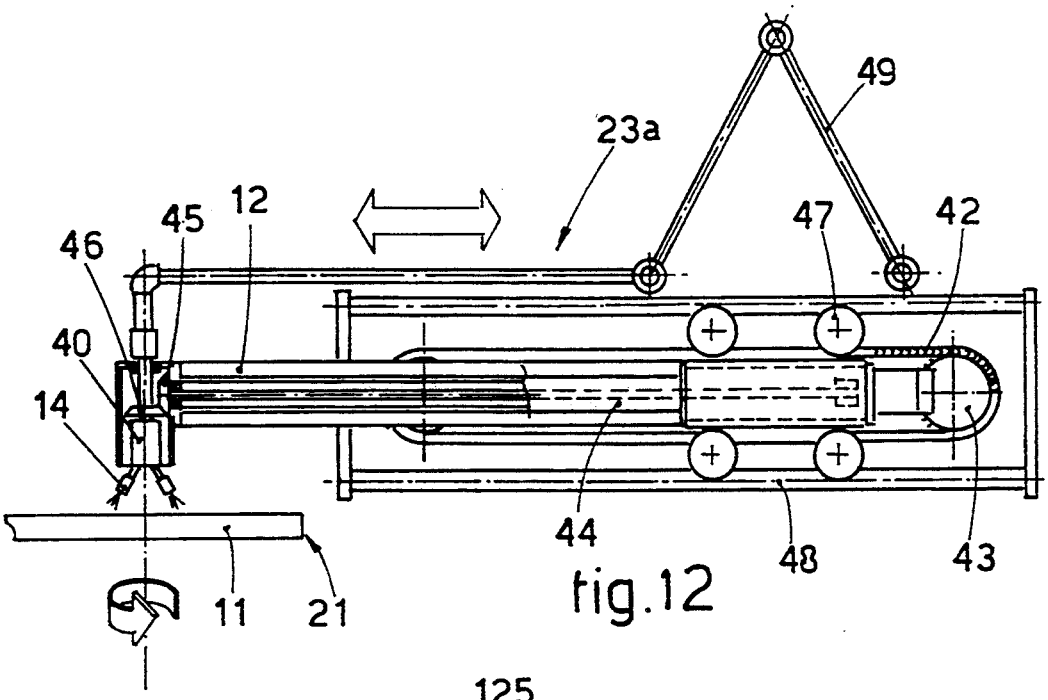
FIG. 12 shows a variant of the linear descaling device of FIG. 1.

In the variant shown in FIG. 12 the movable arm 12 bears a rotary head 40 supporting the nozzles 14.

Movement is imparted to the movable arm 12 by a chain 42 cooperating with a motive wheel 43, which transmits motion to the rotary head 40 by means of a shaft 44 enclosed in the movable arm 12 and by means of tapered pinions 45 and 46.

In this case the movable arm 12 is associated with wheels 47 able to run in guides 48 so as to ensure a linear movement. The water is fed to the nozzles 14 through an extensible tube 49.

Figure 14A:
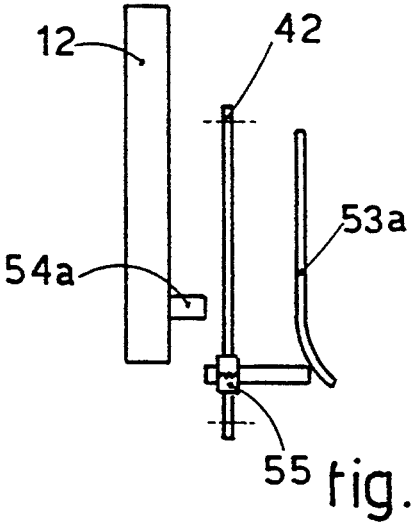
FIGS. 14*a*, 14*b*, 14*c* and 14*d* show a working cycle of a possible embodiment of the linear descaling device of FIG. 12.
Figure 14B:
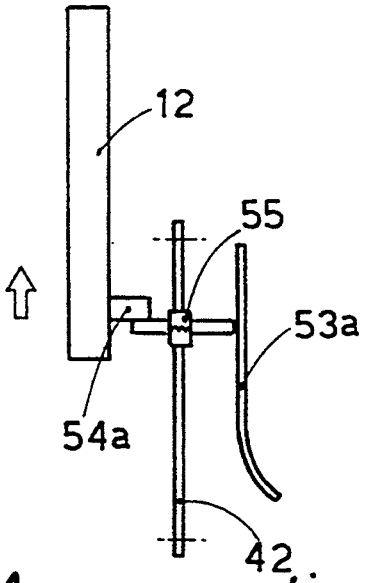
Figure 14C:
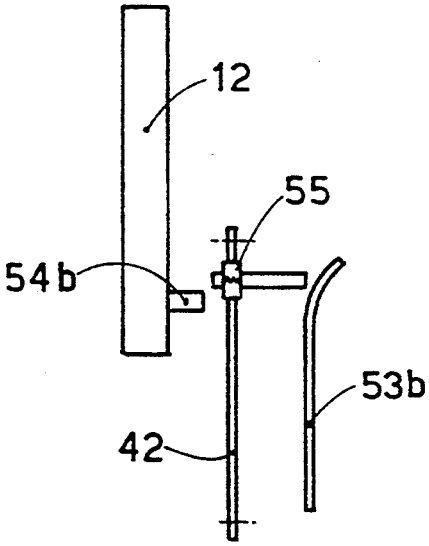
Figure 14D:
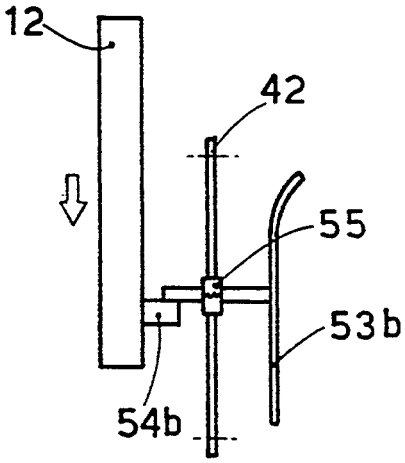
Figure 15:
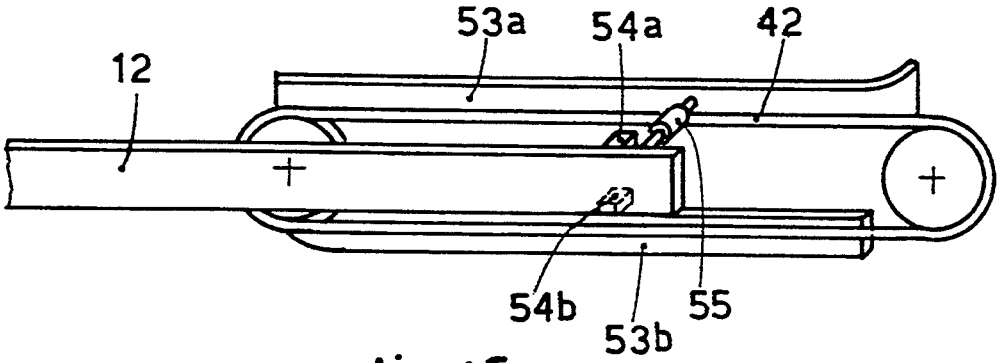
FIG. 15 is a side view of a possible embodiment that performs the cycle of FIGS. 14.

In the example shown in FIGS. 14 and 15 the motion of the chain 42 is converted into a linear reciprocating movement of the movable arm 12 by means of a mechanism which comprises a resilient pivot 55 constrained by and movable with the chain 42, an upper outer guide 53*a* and lower outer guide 53*b* and an upper protrusion 54*a* and lower protrusion 54*b* included on the movable arm 12.

The resilient pivot 55 in its first outward movement encounters the upper outer guide 53*a* at a pre-set position and is thrust resiliently towards the movable arm 12 and meets the upper protrusion 54*a* thereof (FIG. 14*a*).

The pivot 55 in continuing this movement traverses the movable arm 12 by drawing it (FIG. 14*b*) to the point where the upper guide 53*a* ends and the pivot 55 is resiliently distanced from the movable arm 12 and loses contact with the upper protrusion 54*a*.

The pivot 55 in its second return movement encounters the lower outer guide 53*b* (FIG. 14*c*) positioned upside-down as a counterpart to the upper outer guide 53*a* and, in the same way as before, is thrust towards the movable arm 12 so as to come into contact with the lower protrusion 54*b* thereof, thus causing the backward movement of the movable arm 12 by a drawing action (FIG. 14*d*).

According to the variant of FIG. 4 each movable arm 12 bears two pairs of sprayer nozzles 14. At the beginning of the cycle these two pairs are positioned with one pair substantially facing one lateral edge 16 and with the other pair substantially facing the middle 22 of the thin slab 11.

This lay-out enables the cycle times to be reduced substantially by a half or, without reducing the cycle times, the speed of feed of the thin slab 11 to be increased.

According to another embodiment of the invention shown in cooperation with blooms 24 in this case, the nozzles 14 are fitted to a rotary arm 13. The rotary arm 13 is driven by its own motor 25 associated in this example (FIG. 5) with a speed reduction unit 26 with parallel shafts.

The delivery of water to the nozzles 14 is carried out in this case through an outer delivery tube 27 connected to a rotary joint 28, which leads the water through the slow hollow shaft 30 of the speed reduction unit 26 to the rotary arms 13.

The rotary arm 13 is associated with one face of the bloom 24 fed forwards by drawing rolls.

The rotation of the rotary arm 13 is carried out advantageously at the most suitable speed for the best descaling action, for instance with a peripheral speed of the nozzles 14 between 1.75 and 3.50 meters per second, but advantageously about 2.5 meters per second, and performs a descaling action along strips 31, which are adjacent to each other or partly superimposed on each other and are shaped as an arc of a circle.

The speed of rotation of the rotary arm 13 is coordinated with the speed of the feed of the bloom 24, so that a successive pass of the rotary arm 13 laps strips 31 which have not been lapped beforehand by the descaling action, or lapped thereby only very slightly.

The angle of incidence of the jet of water against the surface of the bloom 24 ranges typically from 10° to 30°, but advantageously 15° to 25°.

The distance of the nozzles 14 from the surface of the bloom 24 to be descaled is between 50 mm. and 100 mm., but advantageously about 75 mm., and will be such as will generate enough pressure of impact.

This pressure of impact of the water against the bloom 24 will typically be between 3 and 25 kgs/cm$^2$, depending on the type of steel being processed, the thickness of the bloom and scale, etc.

A metallic plate 32 is fitted between the nozzles 14 and the surface of the bloom 24 downstream of the working zone of the nozzles 14 and is positioned so as not to interfere with the nozzles 14 during the descaling step; but this metallic plate 32, during the complete rotation of the rotary arm 13, prevents the delivery of water from lapping zones of the bloom 24 which have already been descaled and thus obviates excessive cooling of the bloom 24 on its flat surfaces and at its corners.

This metallic plate 32 will include advantageously on its rear a raised edge 33.

The metallic plate 32 will include advantageously, on its face lapped by the jet of water, means which are not shown here but are suitable to break up the pressure of impact, such as protrusions, baffles, rows of chains, etc. This has the purpose of preventing the continual passes of the jet of water over the same points from causing wear or deformation of the plate 32.

The end part of the metallic plate 32 may be inclined so as to direct the water towards a discharge hole 34, which may be associated with means to recover the water.

According to a variant the metallic plate 32 can be inclined to assist the orientation of the water by making use of the direction of rotation.

Figure 5:
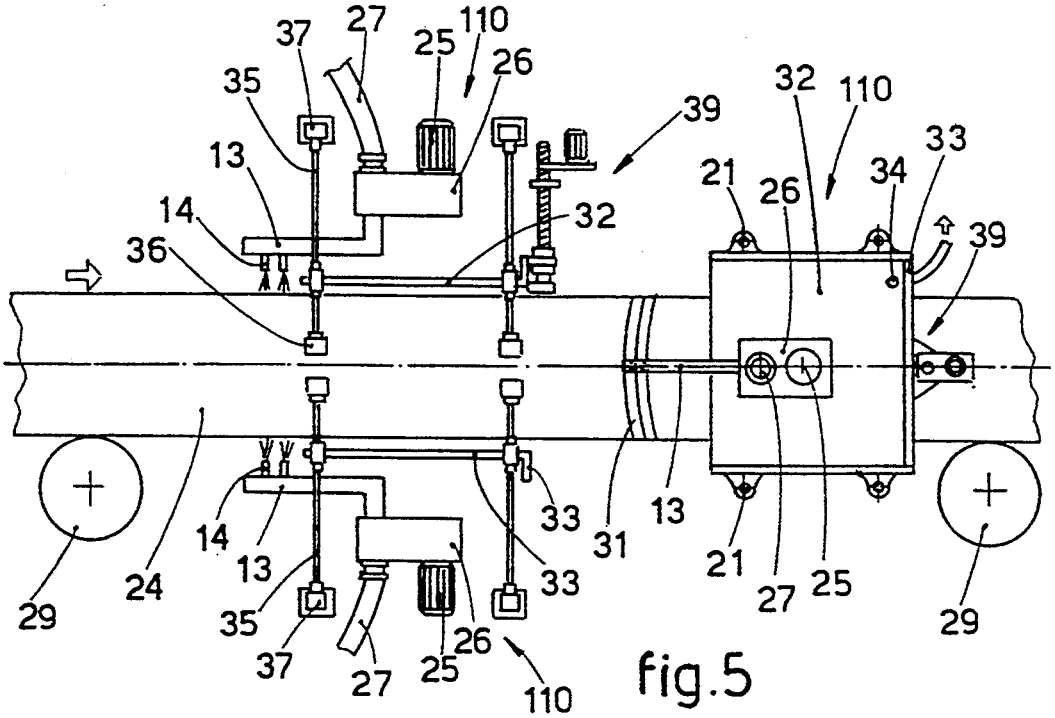
FIG. 5 is a diagram of the descaling device with a rotary arm in cooperation with the four faces of a bloom being fed.
Figure 6:
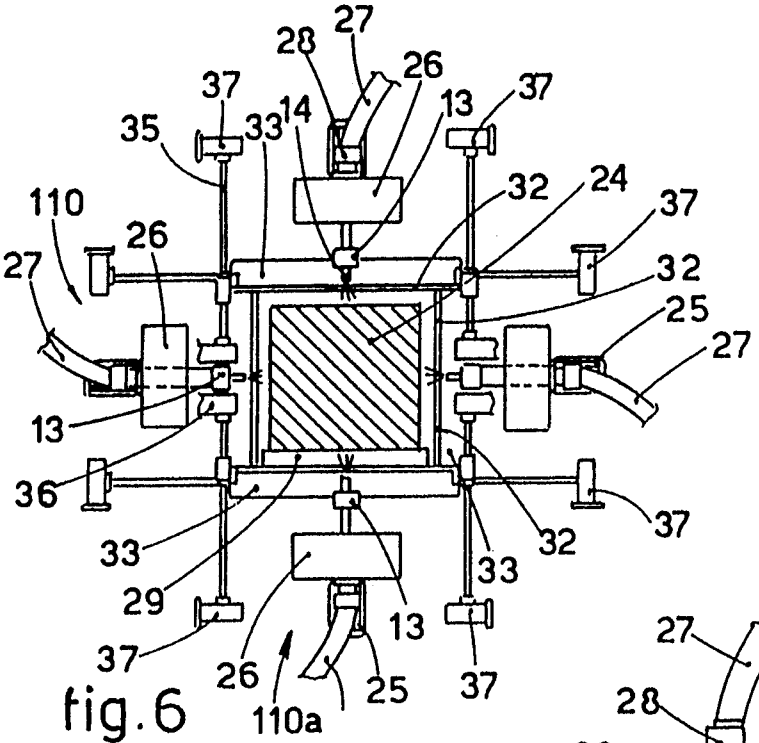
FIG. 6 shows a cross-section of the descaling device of FIG. 5.

FIGS. 5 and 6 show a situation in which four equal rotary descaling devices 110 according to the invention, each of which has one rotary arm 13, act on a bloom 24 having a substantially square cross-section.

Each of the rotary descaling devices 110 in this example is installed on four guides 35, which cooperate with a stationary structure 36 (shown partly) and are secured to supports 37 at their upper end.

In this case the two rotary descaling devices 110 acting on respective opposite faces of the bloom 24 are fitted advantageously on the same axis as each other, whereas the two pairs of rotary descaling devices 110 are reciprocally staggered.

Each of the rotary descaling devices 110, apart from the descaling device **10*a* cooperating with the plane of the drawing rolls 29, comprises means to adjust the position of the nozzles 14 in relation to the plane perpendicular to the axis of feed of the bloom 24. This enables the rotary descaling device 110 to be adjusted for various dimensions of the bloom 24, or slab or billet 11, being fed, thus keeping constant the gap between the nozzles 14 and the surface of the bloom 24** and therefore keeping constant the pressure and angle of impact of the jet of water.

Figure 7:
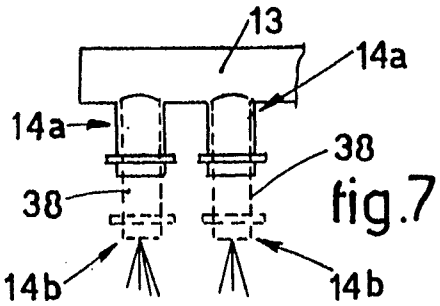
FIG. 7 shows an embodiment for adjustment of the position of the nozzles.

These means to adjust the position of the nozzles 14 may consist (FIG. 7) of extension sleeves 38 which enable the position of the nozzles 14 to be adjusted axially, for instance from a raised position **14*a* to a lowered position 14*b***.

Figure 8B:
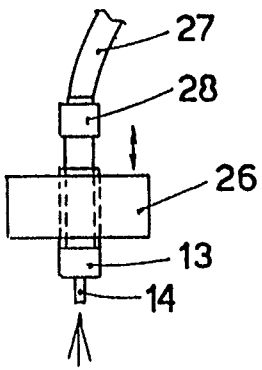
FIGS. 8*a* and 8*b* show a variant of FIG. 6.
Figure 8A:
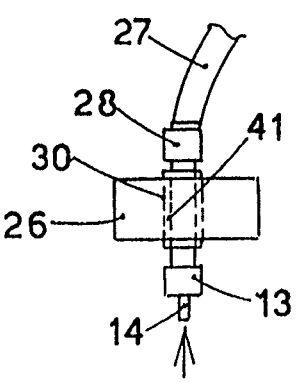

According to the variant shown in FIGS. 8 the adjustment of the axial position of the nozzles 14 is carried out by raising or lowering the through hollow sleeve 41 in the hollow bore 30 of the slower shaft of the speed reduction unit 26, the sleeve 41 being connected to the rotary joint 28 coupled to the water feed tube 27, the sleeve 41 being raised from a low position (FIG. **8*a*) to a high position (FIG. 8*b***) for instance.

The plate 32 includes independent screw adjustment means 39 for its positioning in coordination with the position of the nozzles 14 according to the dimensions of the bloom 24 during processing.

Figure 9:
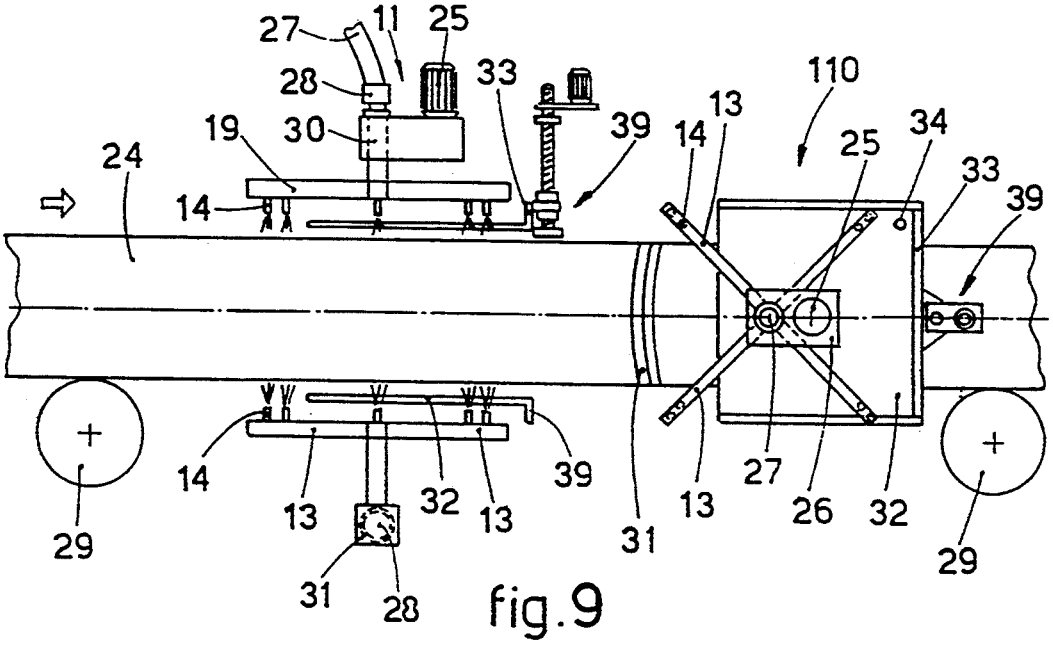
FIG. 9 shows a variant of FIG. 5.

According to the variant of FIG. 9 each rotary descaling device 110 comprises four rotary arms 13, each of which bears two nozzles 14 at its end; the rotary arms 13 advantageously are fitted symmetrically to the axis of rotation.

This embodiment enables the speed of feed of the bloom 24 to be increased while the speed of rotation of the rotary arms 13 remains unchanged, or else enables the speed of rotation of the rotary arms 13 to be reduced while the speed of feed of the bloom 24 remains unchanged.

A descaling system employing four rotary descaling devices 110 according to the invention requires a greatly reduced rate of flow of water, reduced from about 180 to 360 liters per minute, with 8 or 16 nozzles 14 for each of the descaling devices 110.

In particular, the overall rate of flow of water for a lay-out with four rotary descaling devices 110, each device having four rotary arms 13 and each rotary arm 13 bearing four nozzles 14, is 360 liters per minute.

Figure 13:
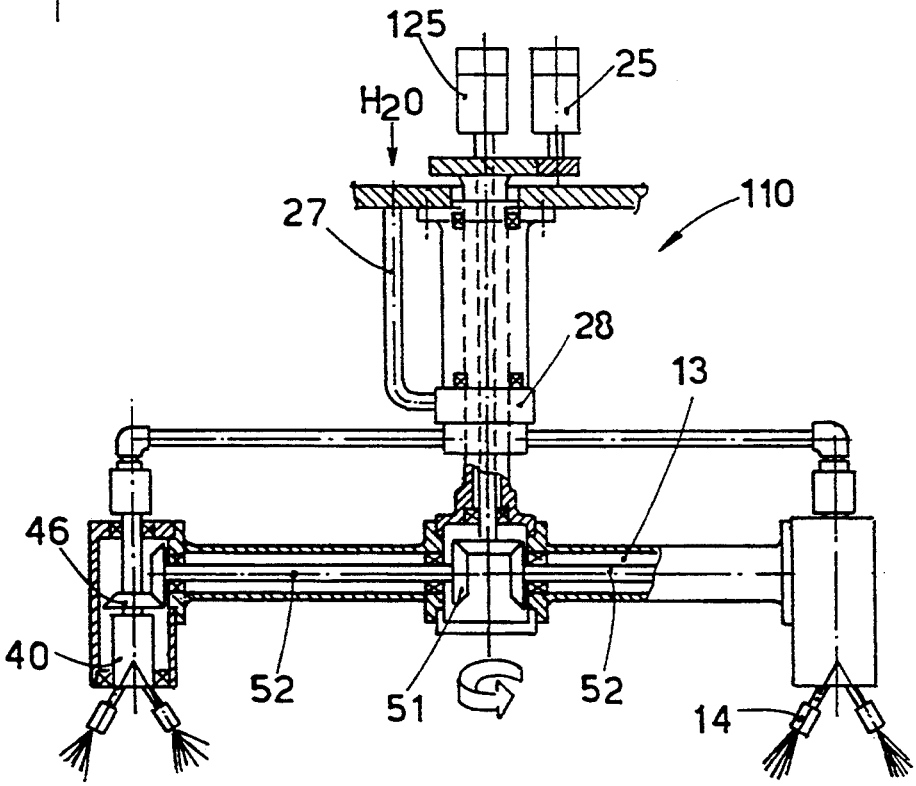
FIG. 13 shows a variant of the rotary descaling device of FIG. 5.

According to the variant of FIG. 13 the rotary descaling device 110 includes two rotary arms 13, each of which bears a rotary head 40 supporting two nozzles 14; this lay-out achieves the combination of two rotary movements in relation to the bloom 24 to be descaled.

Besides a first motor 25 that drives the rotary arms 13, the figure shows also a second motor 125 that drives the rotary head 40; this second motor 125 drives a first shaft 50 which, through a gearwheel 51, sets in rotation two second shafts 52; the two second shafts 52 transmit their motion through tapered pinions 45 and 46 to the rotary nozzle-holder head 40.

Figure 10:
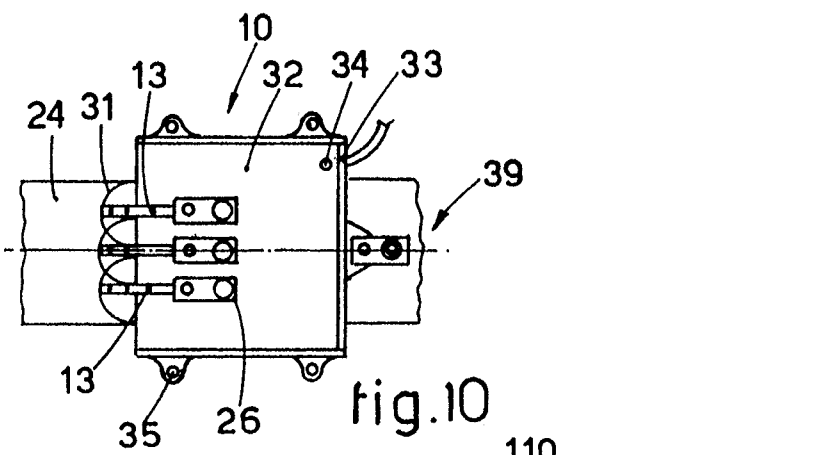
FIG. 10 shows a device including three aligned rotary arms for each side of the slab.

According to the variant of FIG. 10 each rotary descaling device 110 includes three rotary arms 13, which are substantially aligned in relation to the plate 32 and act at the same time on the same face of the bloom 24 by forming adjacent or slightly superimposed strips 31.

This embodiment enables the bloom 24 to be fed faster with a speed of rotation of the rotary arms 13 equal to the speed when there is only one arm 13.

Figure 11:
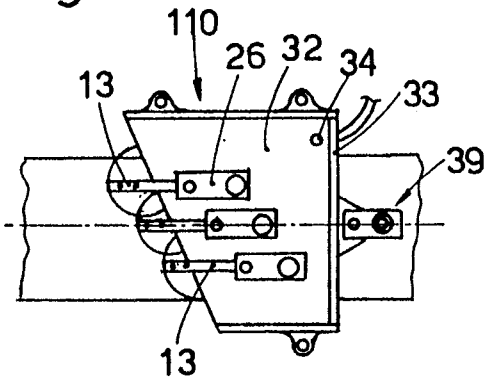
FIG. 11 shows a variant of FIG. 10 including three rotary arms positioned diagonally side by side for each side of the slab.

According to the further variant of FIG. 11 there are three rotary arms 13 aligned diagonally in relation to a line perpendicular to the direction of feed of the bloom 24.

This embodiment, in view of the reciprocal positions taken up by the adjacent jets of water, ensures that the detached scale is discharged laterally and progressively by the adjacent jet of water towards the exterior of the bloom 24.

In the examples shown in FIGS. 12 and 13 the combined arrangement of the movements of the movable arms 12-13 and of the rotary movement of the nozzle-holder head 40 causes on the face of the slab 11 or bloom 24 a scale removal action which can be likened to a milling action. This embodiment, by using cylindrical nozzles 14, enables the water pressure to be raised considerably up to 600–700 bar. By using high values of pressure it is possible to reduce the rate of flow of water while maintaining the efficiency of the descaling action. Moreover, the delivery of water can be adjusted by a system of valves to produce a pulsating pressure.

What is claimed is:

1. Descaling device employing water to descale blooms, slabs or billets being fed in cooperation with the descaling device at a speed of feed on the order of 1.5–20 meters per minute, comprising:

at least one movable arm bearing at least one nozzle for delivering descaling water, said at least one movable arm rotating about an axis of rotation in a full circle, wherein a first portion of said full circle corresponds to a working phase during which descaling water is delivered to and acts on a surface of the bloom, slab or billet, and a second portion of said full circle corresponds to a shut-off phase during which descaling water is prevented from acting on a surface of the bloom, slab or billet; and a plate provided between the bloom, slab or billet and said at least one nozzle when said at least one nozzle is in said second portion of said full circle corresponding to said shut-off phase, said plate protecting the bloom, slab or billet from descaling water from said at least one nozzle during said shut-off phase and containing water on said plate for recovery.

2. Descaling device as in claim 1, in which said at least one movable arm includes at least two delivery nozzles delivering adjacent superimposed water walls.

3. Descaling device as in claim 1, in which the at least one nozzle is positioned between 50 and 100 mm. from the surface of the bloom, slab or billet.

4. Descaling device as in claim 3, which includes means to adjust the distance of the nozzle from the surface of the slab, bloom or billet.

5. Descaling device as in claim 4, in which the angle of incidence of the water with the slab, billet or bloom surface is between 10° and 30°.

6. Descaling device as in claim 1, in which the speed of displacement of the at least movable arm during descaling corresponds to a peripheral speed of the at least one nozzle between about 1.75 and 3.50 meters per second.

7. Descaling device as in claim 1, in which the pressure of impact of descaling water from said at least one nozzle against the surface of the bloom, slab or billet is between 3 and 25 kgs/cm$^2$.

8. Descaling device as in claim 1, in which the at least one nozzle is associated with a rotary nozzle-holder head fitted to the at least one movable arm.

9. Descaling device as in claim 8, in which the water pressure in tubes delivering water to the at least one nozzle may reach 600–700 bar.

10. Descaling device as in claim 1, comprising feeding means for feeding the bloom, slab or billet at a speed on the order of 1.5–20 meters per minute.

11. Descaling device as in claim 1, comprising feeding means for feeding the bloom, slab or billet at a speed on the order of 4–10 meters per minute.

* * * * *

UNITED STATES PATENT AND TRADEMARK OFFICE

CERTIFICATE OF CORRECTION

PATENT NO. : 5,388,602

DATED : February 14, 1995

INVENTOR(S) : COASSIN et al

It is certified that error appears in the above-identified patent and that said Letters Patent is hereby corrected as shown below:

On title page, item,

[75]

"Gianni Rattierri" should read --Gianni Rattieri--.

Signed and Sealed this

Sixth Day of June, 1995

*Attest:*

*Attesting Officer*

BRUCE LEHMAN

*Commissioner of Patents and Trademarks*